US006108822A

United States Patent [19]

Calagui

[11] Patent Number: 6,108,822

[45] Date of Patent: Aug. 29, 2000

[54] BELT WITH REINFORCING STRIP

[76] Inventor: Juanito E. Calagui, P.O. Box 325, Passaic, N.J. 07055

[21] Appl. No.: 09/374,017

[22] Filed: Aug. 16, 1999

[51] Int. Cl.[7] ..... A41F 3/02

[52] U.S. Cl. ..... 2/338

[58] Field of Search ..... 2/235, 236, 237, 2/311, 312, 321, 322, 338, 342, 251, 252, 257, 336, 316, 319, 300; D2/627; D11/200, 218, 220, 230, 231, 234, 235; 24/170, 191, 164, 182

[56] References Cited

U.S. PATENT DOCUMENTS

| | | | |
|---|---|---|---|
| 1,077,250 | 11/1913 | Allum | 2/322 |
| 1,145,797 | 7/1915 | Roach | 2/322 |
| 1,354,771 | 10/1920 | McCormick | 2/322 |
| 1,385,945 | 7/1921 | Heberling | 2/322 |
| 1,388,623 | 8/1921 | Walker | 2/322 |
| 1,566,104 | 12/1925 | Knothe | 2/322 |
| 4,179,755 | 12/1979 | Clark | 2/322 |
| 4,437,598 | 3/1984 | Hull | 224/163 |
| 4,566,158 | 1/1986 | Lau | 24/580 |
| 5,588,186 | 12/1996 | Ko | 24/585 |
| 5,873,133 | 2/1999 | Jurga et al. | 2/322 |
| 5,875,523 | 3/1999 | Chen | 24/171 |

*Primary Examiner*—John J. Calvert
*Assistant Examiner*—Alissa L. Hoey
*Attorney, Agent, or Firm*—Weingram & Associates, PC.

[57] ABSTRACT

The present invention is an improved waistline belt for keeping pants, jeans and skirts in place, and retaining the shape of the belt. The improved waistline belt includes a buckle, split leather straps and a spring-tempered stainless steel plate. A method of constructing the belt is also provided. With the leather belts split apart, an adhesive substance is applied on both inside portions of the split leather straps. A precut spring-tempered stainless steel plate is set into an end portion of the belt between the split leathers opposite to the buckle. The split leathers are glued together. The split leathers are also stitched together along their respective edges to seal the steel plate between the leathers and retain the buckle at an end of the belt opposite to the apertured end. Holes formed in the straps and insert hook the buckle end into a select one of the holes to adjust the belt to the user's waistline.

13 Claims, 4 Drawing Sheets

BELT WITH REINFORCING STRIP

BACKGROUND OF THE INVENTION

1. Field of the Invention

The present invention relates to improved waistline belts for men and women which are used to keep pants, jeans and skirts in place.

2. Description of the Related Art

Belts which encircle a user's waistline to hold up pants, jeans and skirts are known. For example, the belt can consist of a single solid uniform strap of rubber or leather having a buckle at one end with an engaging stud, while at the other end of the strap, a plurality of holes are formed therethrough to coact with the stud. This manner of construction provides for the adjustment of the belt buckle with respect to the length of the strap so that the user can cinch the belt to accommodate his or her waistline.

Other known belts consist of two straps which are sewn together along their edges to form the main strap to which the buckle is mounted. This manner of construction is usually employed where an exotic skin, such as that of a reptile, fish or rare mammal hide will be displayed as the exterior strap. A more rugged hide of leather such as that from a steer arranged to be worn at the inside of the belt closest to the wearer where friction and abrasion occur. Similarly, with this "split" strap construction, the buckle assembly is mounted at one end of the main strap to engage one of a plurality of apertures at the other end to again cinch the belt to accommodate the user's waist.

There are disadvantages to these types of constructions for the belt. The first is that, regardless of the leather, the belt end having the adjustment apertures becomes frayed and loses its rigidity as a result of repeated use. The belt becomes somewhat limp and flaps uncontrollably at the user's waist. This often necessitates the added construction of a loop adjacent the buckle and encircling the main strap to receive and retain the loose end of the belt. However, especially with the more supple leathers, this is often insufficient to prevent the free end of the belt from loosely flapping and therefore, presenting a somewhat disheveled appearance at the waist.

Additionally, the repeated insertion of the engaging stud of the buckle into the same aperture of the belt will wear down the receiving aperture so that eventually, the buckle stud is easily dislodged from the retaining aperture upon movement of the user's waist.

Moreover, as the leather strap begins to age, the waistband of the user's pants will roll over the strap, again providing a disheveled appearance at the user's waist. This is especially true where the user gains weight along the midsection or suffers from the physical characteristic of a "pot belly".

OBJECTS AND SUMMARY OF THE INVENTION

It is an object of the present invention to provide an improved waistline belt which retains its shape when adjusted to the wearer to keep pants, jeans, skirts, and other articles of clothing in place.

It is another object of the present invention to provide an improved waistline belt which substantially reduces, if not eliminates, fraying and softening of the apertured end of the belt.

It is another object of the present invention to provide an improved waistline belt having a rigid construction to prevent the trousers from "rolling over" the belt under the pressure of a distended stomach.

It is another object of the present invention to provide an improved waistline belt having an apertured end which lies substantially flush with the standing portion of the belt after it has been threaded through the belt loops of the garment.

It is another object of the present invention to provide an improved waistline belt which has a flexible metallic insert disposed at the interior of the apertured end of the belt to enable said end to be positioned to conform substantially to a waist of the wearer.

It is another object of the present invention to provide an improved waistline belt having a buckle mounted to an end of the belt and spaced therefrom for the apertured end to be guided through the space.

It is another object of the present invention to provide an improved waistline belt having the buckle assembly adjustable with respect to the end that it is mounted to for coaction with the opposite apertured end of the belt.

It is another object of the present invention to provide an improved waistline belt having a strap holder being adapted for pivotal coaction with a buckle for the belt to provide increased comfort for the wearer.

It is another object of the present invention to provide an improved waistline belt having a strap holder with a screw securing means for securing the strap to the buckle regardless of the physical activity of the user.

It is another object of the present invention to provide an improved waistline belt constructed with an insert to reinforce the holes and associated region of the belt.

It is another object of the present invention to provide a spring action on an end of the belt for durability and long lasting use.

It is yet another object of the present invention to reinforce the apertured end portion of the belt to facilitate easy entry into the belt loops of the garment.

The improved waistline belt of the present invention includes in one embodiment a pair of split leather straps, a buckle, and a spring-tempered stainless steel plate. The straps are glued together along their respective peripheral edges to form the belt with the steel plate sandwiched between the straps at one end of the resulting belt. A plurality of adjustment holes are formed in that end of the belt to extend through the straps and the steel plate sandwiched therebetween. An opposite end of the belt has a buckle secured thereto which is spaced from the belt so that the apertured end can be threaded underneath the buckle and adjustably secured.

The improved waistline belt of the present invention also calls for a method of manufacturing the belt, wherein with the leather straps in split stage, a strong leather adhesive substance is first applied to both inside portions of the leather straps. A precut, spring-tempered stainless steel plate is placed between the end portion of the straps opposite to where the buckle is mounted and the straps glued together. The edge of the straps are sewn to form the belt and to provide a loop hole for the buckle attachment. The buckle stud receiving holes are punched through one end of the belt and steel plate therebetween for receiving the buckle.

BRIEF DESCRIPTION OF THE DRAWINGS

For a more complete understanding of the present invention, reference may be had to the detailed description of preferred embodiments of the present invention taken in conjunction with the drawings, of which.

DETAILED DESCRIPTION OF THE PREFERRED EMBODIMENTS

Figure 1:
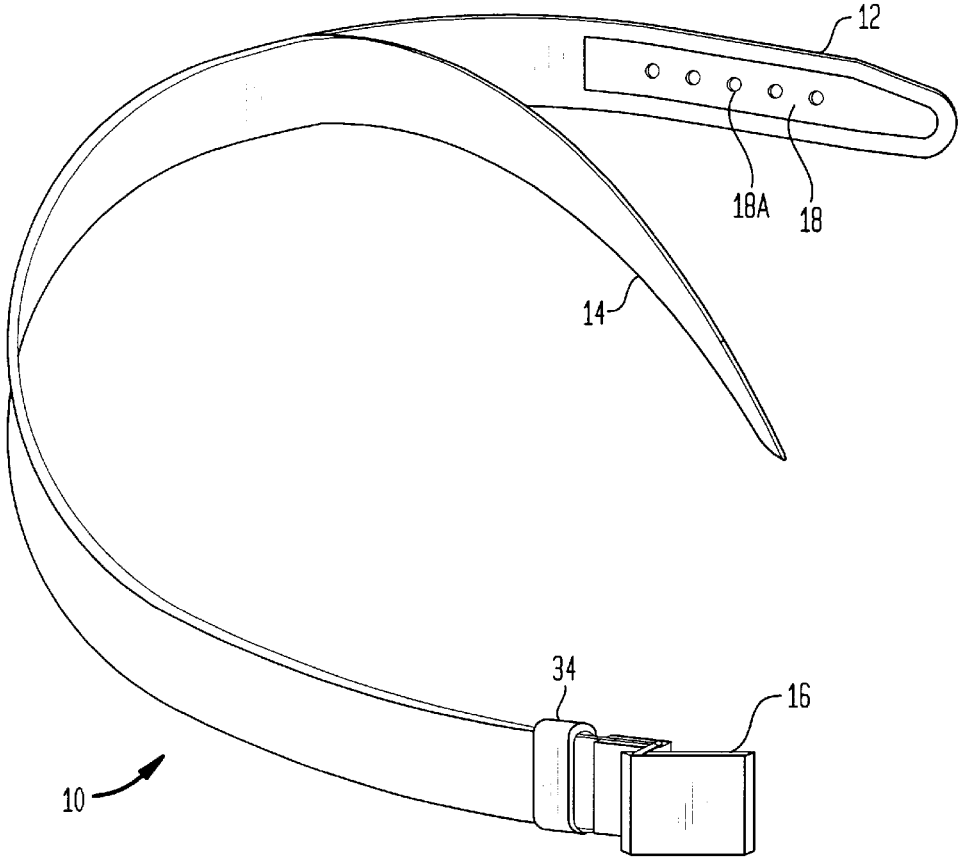
FIG. 1 is a perspective view of an improved waistline belt according to the present invention.
Figure 2:
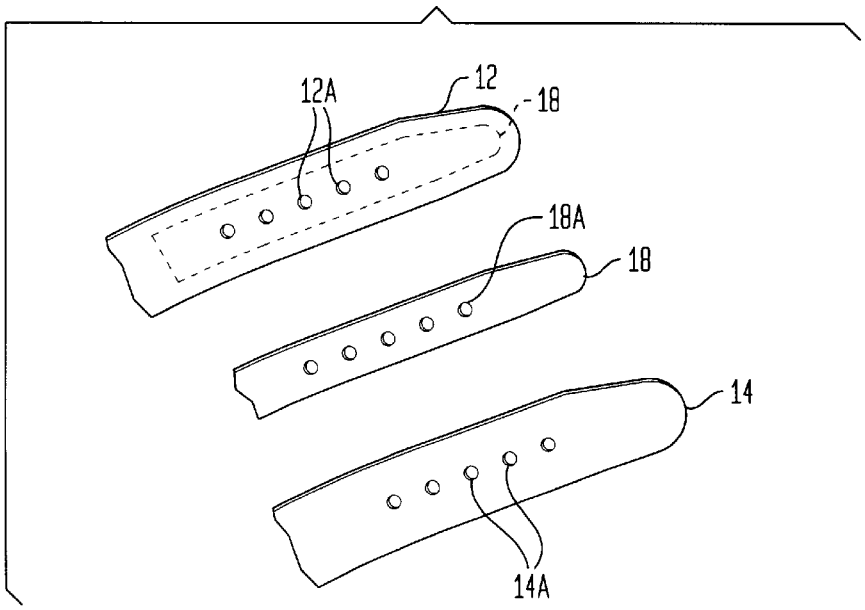
FIG. 2 is a view of a portion of the improved waistline belt according to the present invention showing the positioning of the insert for the belt.

The improved waistline belt according to the present invention is shown generally at 10 as in FIGS. 1 and 2. In one embodiment, the belt 10 includes a pair of leather straps 12,14 of preferably the same length. The pair of straps 12,14 when joined together as discussed below, form the belt of the present invention. The straps 12,14 are formed at each of their respective ends with a corresponding number of apertures 12A and 14A.

The pair of straps at 12,14 are joined at the respective opposite ends to secure a buckle 16 at an opposite end of the belt. The buckle 16 is preferably constructed of steel or other alloy.

Referring in particular to FIG. 2, a spring-tempered stainless steel plate 18 is disposed at one end of the belt between straps 12,14. The steel plate 18 or reinforcing member is flexible and formed with a plurality of apertures 18A. The apertures 18A are in registration with the apertures 12A,14A when the plate 18 is mounted in position between the straps 12,14. With this manner of construction, the plate 18 is sandwiched between the ends of the strap 12,14 and secured therein for the belts final construction.

Figure 3:
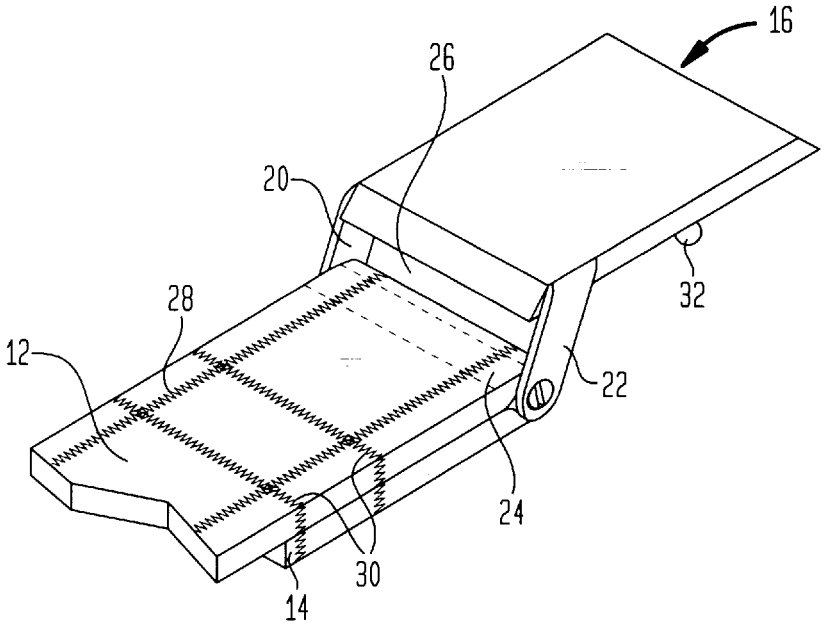
FIG. 3 is a view of a buckle for the waistline belt of the present invention.
Figure 4A:
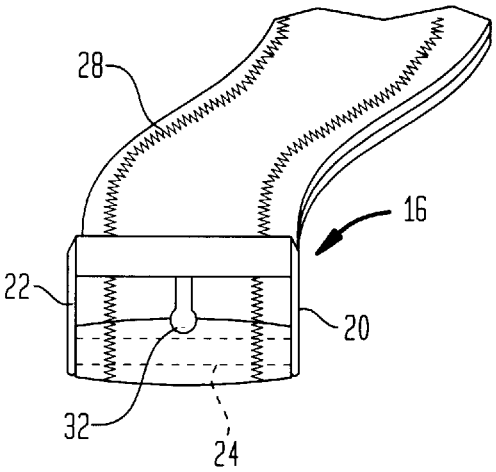
FIGS. 4A, 4B are front and rear views, respectively, of the buckle of FIG. 3.
Figure 4B:
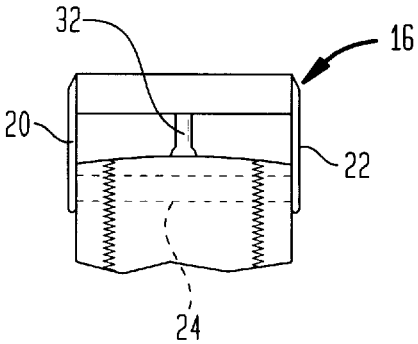

In FIG. 3, the buckle 16 is shown for the present invention. The buckle 16 can assume substantially any shape in addition to the one shown and is formed with a pair of support posts 20,22 extending therefrom. The posts 20,22 are substantially symmetrical with respect to their position at the buckle 16. A horizontal post or bar 24 extends between and interconnects the posts 20,22. The bar 24 is preferably of cylindrical construction, although other shapes can be used. The cylindrical construction reduces abrasion or the straps 12,14 mounted thereto.

As shown in FIG. 3, a space 26 is provided between the buckle 16 and the bar 24 through which the straps 12,14 are guided and then folded upon themselves to secure the buckle 16 to the belt. The straps 12,14 are stitched generally at 28 along a corresponding peripheral edge of each strap 12,14 to augment the adhesive qualities of the glue previously used to secure the straps 12,14 together and the steel plate 18 therebetween. The straps 12,14 are also stitched preferably at 30 transverse to a longitudinal axis of the straps 12,14 to secure the straps to each other after having been folded over the bar 24 of the buckle 16.

The support posts 20,22 are preferably of a fixed rigid construction, thereby supporting the buckle 16 off the straps. This prevents the buckle 16 from abrading the straps 12,14 when threaded through the space 26 for a mounting stud 32 of the buckle 16 to engage a select one of the apertures 12A,14A,18A.

The belt can also be provided with a loop 34 (FIG. 1) through which the straps 12,14 can be threaded if the garment for which the belt is used has belt loops spaced apart a substantial distance. The loop 34 can be made from the same material as that used in the straps 12,14 or from metal, plastic, etc.

The plate 18 sandwiched between the straps 12, 14 is preferably a thin steel plate for its flexibility qualities, and can also be made from plastics. Although not as desirable for its lack of flexible qualities, the plastic construction can be preformed to a select curvature to conform to the waistline of a wearer. That is, an individual wearing, for example, a belt having a length of 40 inches, would find that the insert 18 has a prefabricated bend thereto to accommodate an individual with such a waist dimension. As shown in FIG. 2, the insert 18 can be constructed with a prefabricated arcuate shape so that when sandwiched between the straps 12,14 of the belt, and used by the wearer, that end of the belt conforms substantially to and lies against the standing portion of the belt after the buckle 16 has been engaged.

Figure 5:
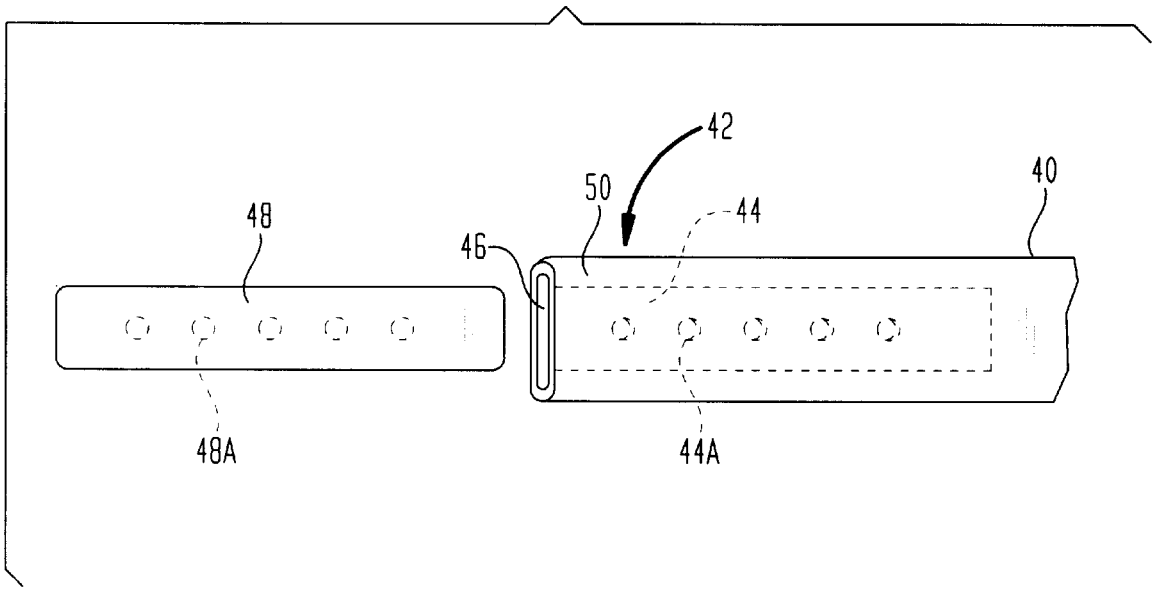
FIG. 5 is a view of an apertured end of another embodiment of the waistline belt according to the present invention.

FIG. 5 shows another embodiment of the improved waistline belt according to the present invention. In this embodiment, the straps 12,14 are replaced by a single uniform heavy leather strap 40 for the belt. The strap 40 has at one end 42 a pocket 44 formed therein and accessible at an opening 46 of the belt 40. The pocket 44 is of a size and shape sufficient to receive an insert 48. The insert 48 is formed of a material similar to that which was discussed with respect to FIGS. 1,2. The pocket 44 and insert 48 can be preconstructed with corresponding apertures 44A,48A which are in registration with each other when the insert 48 is disposed in a pocket 44. Alternatively, the insert 48 can be a continuous longitudinal member having the construction discussed above and which is disposed in the pocket 44 after which the apertures 44A,48A are punched through the belt 40 and the insert 48.

The aperture 46 can be closed via pressure heat seal or plugged with a leather material which is similarly heat-press fitted into position. Another manner of sealing the aperture 46 is to fold the belt 40 back along itself at an area shown generally at 50 and thereafter heat seal or stitch that end of the belt closed to retain the insert 48 in position within the pocket 44.

Figure 6:
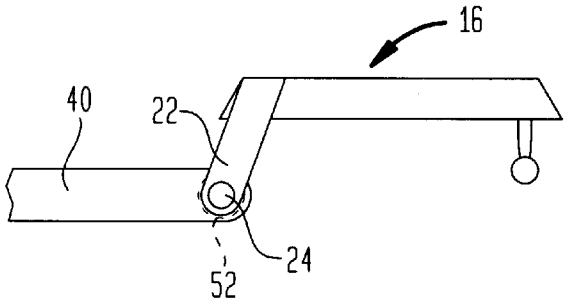
FIG. 6 is a view of the buckle mounted to the end of the belt shown in FIG. 5.

In FIG. 6, the buckle 16 is shown mounted to this particular belt 40 which is a continuous piece of leather. The belt 40 at the buckle end is provided with a passage 52 extending along an end of the belt 40 transverse to a longitudinal axis of the belt 40. The passage 52 is constructed and arranged in the belt 40 to receive the bar 24 for the posts 20,22.

The construction of the belt 40 in FIGS. 5 and 6, without the stitching, provides for a smooth, clean, uniform appearance of the belt and the mounting of the buckle.

Figure 7:
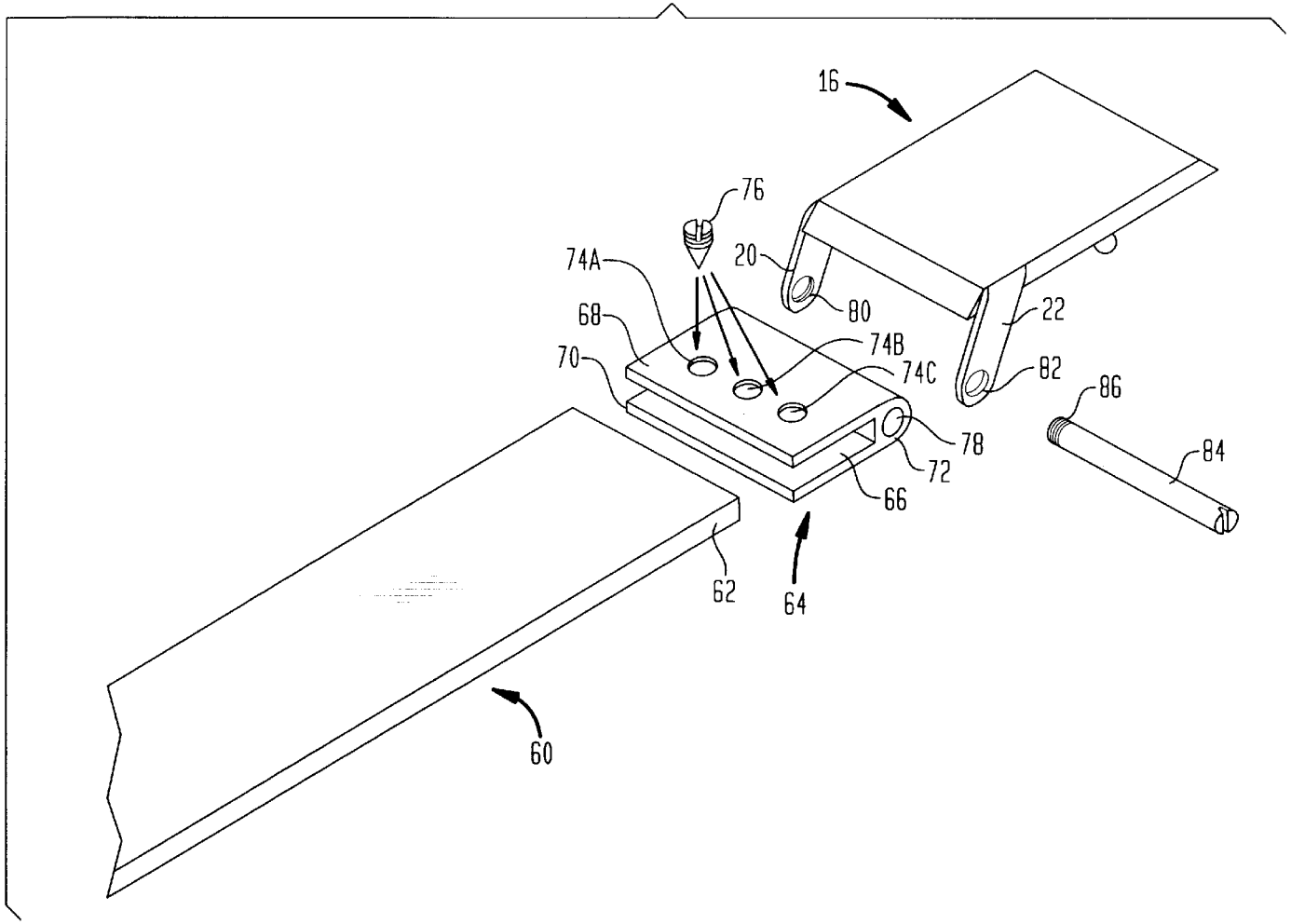
FIG. 7 is a view of a buckle and strap holder for the buckle of the improved waistline belt according to the present invention.

FIG. 7 discloses a buckle arrangement for another embodiment of the improved waistline belt according to the present invention. A strap 60 has an end 62 sized and shaped to be received in a strap holder 64. The strapholder 64 is constructed preferably of metal. The strapholder 64 is formed with a slot 66 into which the end 62 of the strap 60 is inserted. The dimensions of the slot 66 preferably correspond with the width and height of the strap 60 so that when the end 62 is inserted into the slot 66, the width of the strap 60 does not extend beyond a width of the slot 66.

The strapholder 64 is constructed in an elongated U-shape, resembling a clip, wherein a pair of arms 68,70 are joined at a transition region 72 of the holder 64. A plurality of threaded holes 74A,74B,74C (74A–C) are formed in the arm 68 to receive a plurality of corresponding screws, such as a screw shown generally at 76. In this construction, when the end 62 of the strap 60 is inserted into the slot 66 of the holder 64, the plurality of screws 76 are threaded through their respective holes 74A–C into the strap to retain the strap in the slot 66 of the holder 64.

The transition region 72 of the holder 64 is provided with a channel 78 extending completely through the transition region 72 for a purpose to be described hereinafter.

The posts 20,22 of the buckle 16 are each provided with a corresponding aperture 80,82 to receive a stud or pin 84 having a threaded end 86. Aperture 80 is threaded to receive the threaded end 86 of the stud 84. The stud 84 is inserted through the apertures 80,82 and the channel 78 of the strapholder 64 to releasably engage the strapholder 64 with the posts 80,82. The stud 84 is then threaded down to secure the buckle into position with respect to the strapholder 64 to provide the space 26, as described with respect to FIG. 3, for example.

An opposite end of the strap 60 is provided with a construction having the insert 18 or 48, depending upon the particular belt 60 employed. The insert 18,48 in the end 42 of the belt 60 is difficult to accurately cut the end of the belt for length adjustment. Therefore, the groove 66 in the strapholder 64 is of a sufficient depth that the overall length of the belt can be slightly adjusted depending upon the depth to which the end 62 is inserted into the slot 66. As shown in FIG. 7, the end 62 is positioned in the slot 66, with the apertures 74A–C in registration with a select region of the strap 60. The screws 76 are threaded through the corresponding apertures 74A–C into the strap end 62 to secure the belt to extend from the strapholder 64 to a desired length.

Rubber material can also be used to construct the straps 12,14 of the belt 40,60.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A belt, comprising: retaining means for retaining a garment at a select position on a wearer, the retaining means comprising:

a pocket constructed and arranged to a predetermined size and shape at an interior of the retaining means, first passage means extending through the retaining means and in communication with the pocket;

first engaging means mounted to said retaining means away from said pocket; and second engaging means having a substantially rigid construction disposed in the pocket of said retaining means, the second engaging means being constructed and arranged to fit within the pocket and having:

second passage means extending through the second engaging means, the second passage means in registration with the first passage means when said second engaging means is disposed within said pocket to releasably engage the first engaging means and urge the retaining means at the second engaging means against a portion of the retaining means.

2. The belt according to claim 5, wherein the retaining means comprises:

a flexible strap.

3. The belt according to claim 1, wherein the retaining means comprises:

an end portion adapted for being folded about a portion of the first engaging means to mount the first engaging means to the retaining means.

4. The belt according to claim 1, wherein the first engaging means comprises:

a buckle mounted to the retaining means, the buckle having:

a pair of posts extending in spaced relation from the buckle and being connected to the retaining means for providing a space between the buckle and the retaining means.

5. The belt according to claim 4, further comprising:

a pin coacting with the pair of posts for securing the retaining means to the first engaging means.

6. The belt according to claim 1, wherein the second engaging means comprises:

a spring-tempered steel plate adapted for being releasably engaged with the first engaging means to adjust a circumference of the retaining means.

7. The belt according to claim 1, wherein the retaining means comprises:

a pair of flexible straps in facing engagement with each other for providing the pocket having the predetermined size and shape into which is fit the second engaging means.

8. The belt according to claim 1, wherein the second engaging means comprises:

a thin spring-tempered steel member constructed and arranged to fit within the pocket for substantially conforming to a shape similar to the shape of the retaining means.

9. The belt according to claim 1, wherein:

the first passage means comprises:

a first plurality of apertures extending through the retaining means, and the second passage means comprises:

a second plurality of apertures extending through the second engaging means, the second plurality of apertures in registration with the first plurality of apertures for releasably receiving the first engaging means at selected apertures of the first and second plurality of apertures.

10. The belt according to claim 1, further comprising:

joining means for joining the first engaging means to the retaining means.

11. The belt according to claim 10, wherein the joining means comprises:

a support member constructed and arranged with a receiving end for receiving the retaining means, and a holding end for holding the support member to the first engaging means.

12. The belt according to claim 11, wherein the support member comprises:

a U-shaped member having a groove therein for receiving the retaining means; and a mounting region opposite to the groove for being removably mountable to the first engaging means.

13. The belt according to claim 12, further comprising:

a mechanical fastener adapted to coact with the mounting region to removably mount the mounting region of the support member with the first engaging means.

* * * * *